US010046368B2

(12) United States Patent
Pietzka et al.

(10) Patent No.: US 10,046,368 B2
(45) Date of Patent: Aug. 14, 2018

(54) DEVICE AND METHOD FOR PROCESSING METAL PARENT PARTS AND FOR SORTING METAL WASTE PARTS

(71) Applicant: SCHULER PRESSEN GMBH, Goeppingen (DE)

(72) Inventors: Daniel Pietzka, Heiningen (DE); Daniel Sawatzki, Eschenbach (DE); Michael Werbs, Stuttgart (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 0 days.

(21) Appl. No.: 15/424,813

(22) Filed: Feb. 4, 2017

(65) Prior Publication Data

US 2017/0232479 A1 Aug. 17, 2017

(30) Foreign Application Priority Data

Feb. 16, 2016 (DE) ..... 10 2016 102 656

(51) Int. Cl.
*B07C 5/34* (2006.01)
*B07C 5/342* (2006.01)

(52) U.S. Cl.
CPC ..... *B07C 5/3412* (2013.01); *B07C 5/342* (2013.01); *B07C 5/3422* (2013.01); *B07C 2501/0054* (2013.01)

(58) Field of Classification Search
CPC ..... B07C 5/02; B07C 5/34; B07C 5/3412; B07C 5/342; B07C 5/3422; B07C 2501/0054
See application file for complete search history.

(56) References Cited

U.S. PATENT DOCUMENTS 3,895,358 A * 7/1975 Pearl ..... G06Q 10/043 700/1
4,028,167 A * 6/1977 Gerber ..... B26D 7/27 156/384
5,125,149 A * 6/1992 Inaba ..... B23P 19/001 198/341.05
5,141,572 A * 8/1992 Gerber ..... B26D 7/018 156/362

(Continued)

FOREIGN PATENT DOCUMENTS

DE 100 02 368 C2 11/2001
DE 20 2009 006 383 U1 9/2009

(Continued)

*Primary Examiner* — Joseph C Rodriguez
(74) *Attorney, Agent, or Firm* — R. S. Lombard

(57) ABSTRACT

A device and a method for processing parent parts and for sorting waste parts thereby separated. For this purpose, an optical detection unit is provided, which is configured to detect at least one geometric feature G of each waste part and to generate a control signal S corresponding to the at least one detected geometric feature G. The control signal S is transmitted to a sorting unit. The fed waste part is sorted depending on the received control signal S. It is thus possible to assign the separated waste parts to a specific parent part. This in turn enables an assignment and determination of the material of which the waste part consists, which specifically corresponds to the material of which the parent part consists. This enables the waste parts to be separated into different categories.

13 Claims, 3 Drawing Sheets

(56) References Cited

U.S. PATENT DOCUMENTS

| | | | | |
|---|---|---|---|---|
| 5,621,864 | A * | 4/1997 | Benade | G06K 1/121 358/1.18 |
| 5,992,280 | A | 11/1999 | Oishi et al. | |
| 6,298,275 | B1 * | 10/2001 | Herman, Jr. | B26D 5/00 382/111 |
| 6,455,803 | B1 * | 9/2002 | Fields, Jr. | B23K 26/032 219/121.6 |
| 6,788,995 | B1 * | 9/2004 | Lindstrom | G05B 19/4189 700/183 |
| 6,817,829 | B2 * | 11/2004 | Kameda | B65G 61/00 414/789.6 |
| 8,155,778 | B1 * | 4/2012 | Barcock | F24F 13/0245 700/172 |
| 8,596,461 | B2 * | 12/2013 | Susnjara | G06Q 90/00 209/3.3 |
| 9,676,003 | B2 * | 6/2017 | Kara | B65G 47/967 |
| 2002/0072824 | A1 * | 6/2002 | Susnjara | G05B 19/41865 700/171 |
| 2012/0330449 | A1 * | 12/2012 | Edwards | B26D 5/00 700/97 |
| 2013/0125721 | A1 | 5/2013 | Callucci | |
| 2016/0199884 | A1 * | 7/2016 | Lykkegaard | B07C 5/02 700/223 |

FOREIGN PATENT DOCUMENTS

| | | | |
|---|---|---|---|
| DE | 10 2009 056 813 | A1 | 6/2011 |
| DE | 2010 005 019 | A1 | 7/2011 |
| DE | 10 2010 037 951 | A1 | 4/2012 |
| DE | 10 2011 12 592 | A1 | 8/2012 |
| EP | 1 524 063 | A1 | 4/2005 |
| EP | 2 873 471 | A | 5/2015 |

* cited by examiner

DEVICE AND METHOD FOR PROCESSING METAL PARENT PARTS AND FOR SORTING METAL WASTE PARTS

CROSS-REFERENCE TO RELATED APPLICATION

This application claims the priority benefits of German Application No. 10 2016 102 656.5 filed Feb. 16, 2016. The said German Application No. 10 2016 102 656.5 is incorporated herein by reference as though fully set forth.

BACKGROUND OF THE INVENTION

The invention relates to a device and a method for processing metal parent parts and also for sorting metal waste parts thereby produced.

When processing metal parts, metal waste parts can be produced as a result of separation processes, such as punching or cutting. The metal waste parts are collected for recycling. When recycling, it is important to separate the different individual waste parts from one another, where possible.

DE 100 02 368 C2 proposes sorting waste on the basis of its color. For this purpose, the waste is size-reduced and ferromagnetic material is separated first. The rest of the material is treated with inorganic or organic reagents in order to bring about a color reaction. The waste parts can then be separated and sorted using a color camera, depending on their obtained color.

The outlay for such a method is relatively high. In addition, chemical waste products can be produced here as a result of the use of the reagents.

Another approach for separating waste material is known from DE 10 2009 056 813 A1. There, by means of an influx of waste material in a gas flow, a separation into sub-flows is performed on the basis of the movement or flight behavior of the material. The material flows divided on account of their movement or flight behavior are detected using an x-ray detector in order to determine the material. Here, the radiation intensity and the radiation energy at the x-ray detector can be adapted to the material flows already separated from one another beforehand. Such an x-ray detector requires appropriate industrial safety measures. The arrangement is therefore complex and expensive.

In order to separate and sort waste parts formed from aluminium alloys, DE 20 2009 006 383 U1 proposes firstly size-reducing these waste parts and stripping them of any coating. X-ray fluorescence spectroscopy is then performed in order to obtain a separation and sorting of the different aluminium alloys. Such a method also necessitates a high outlay and appropriate industrial safety measures Proceeding from the known prior art, it can be considered the object of the present invention to create a simple possibility for separating metal waste parts within the scope of a processing of a metal parent part.

SUMMARY OF THE INVENTION

The invention relates to a device (10) and a method for processing parent parts (11) and for sorting waste parts (12) thereby separated. For this purpose, an optical detection unit (38) is provided, which is configured to detect at least one geometric feature G of each waste part (12) and to generate a control signal S corresponding to the at least one detected geometric feature G. The control signal S is transmitted to a sorting unit (33). The fed waste part (12) is sorted depending on the received control signal S. It is thus possible to assign the separated waste parts (12) to a specific parent part (11). This in turn enables an assignment and determination of the material of which the waste part (12) consists, which specifically corresponds to the material of which the parent part (11) consists. By way of example, it is thus possible in the case of large press facilities to distinguish between the different waste parts (12) transported in a common material flow through a conveying unit (28), in such a way that the origin of said waste parts from a parent part (11) and consequently the material thereof can be determined. This enables the waste parts (12) to be separated into different categories. This object is achieved by a device and method having the features of the claims.

In accordance with the invention, a device and a method for processing metal parent parts and for sorting metal waste parts are proposed. Here, the parent part is brought into the desired contour, wherein at least one portion to be separated is separated from the parent part by a separation unit and each separated portion forms a waste part. In addition, the parent part can optionally also be shaped into a desired three-dimensional form, for example by a drawing process by means of a press or a press station. The separation unit can, for example, also be provided by a press or press station equipped with a separation tool. By way of example, a press or a press station can comprise a punching tool or cutting edges on a ram.

In order to carry away the at least one separated waste part, a conveying unit can be provided by way of example. The conveying unit can comprise various conveying means, such as chutes and/or shafts and/or conveying belts and/or conveying chains and other known conveying means. A sorting unit is provided in order to sort the at least one waste part. For this purpose, the sorting unit transmits a control signal from an optical detection unit which detects the waste parts. The optical detection unit is configured to detect at least one geometric feature on each waste part. By way of example, the outer contour of the waste part and/or the contour of a portion or region of the waste part are/is considered to be a geometric feature, such as the contour of a protrusion and/or an indentation, etc. The geometric feature by way of example can be the diameter of an indentation or a through-passage. For unambiguous assignment, a plurality of individual geometric features of a waste part can also be detected and linked.

The control signal is generated and transmitted to the sorting unit depending on the at least one detected geometric feature. The sorting unit in one exemplary embodiment has at least one feed channel for feeding the waste parts and at least two or more outlet channels. Here, the conveying device can deliver the conveyed waste parts to the feed channel. On the basis of the control signal, a waste part delivered to the feed channel can thus be forwarded by the sorting unit to a specific one of the provided outlet channels. It is alternatively also possible to initially collect the waste parts unsorted, and for the sorting unit to perform the sorting process separately from the separation unit. The sorting unit and the separation unit can be connected by means of a common conveying unit, however this is not absolutely necessary. The sorting unit can also comprise one or more sorting robots by way of example, to which the control signal is transmitted and which removes one of the waste parts from the unsorted waste parts and sorts this depending on the control signal, i.e. for example places it in a specific container or feeds it to a specific conveying channel in order to be transported on further. A waste part can be grasped from a container or from a conveyed flow of waste parts.

A separate optical detection unit can be assigned to each sorting robot.

The sorting robot or gripper arm thereof can orientate the waste part in the field of view of the optical detection unit such that the at least one geometric feature can be reliably detected.

The optical detection unit can also be arranged movably. The at least one waste part can thus be considered from different directions. It is also possible in particular to arrange the optical detection device on the at least one sorting robot, for example on a gripper arm.

The at least one geometric feature thus serves as a sorting criterion. In this way, it is possible in a very simple manner to sort waste parts depending on their material. When processing parent parts, for example in a press facility, the same material for the parent part is always used for a specific part to be produced. Here, geometrically characteristic waste parts accrue. The geometric feature detected by the optical detection unit can thus also be linked to the material of the parent part. In this way, it is possible to feed waste parts made of a specific material to a specific conveying channel and/or to deposit these in a specific container and sort them into specific categories.

Due to the invention, chemical treatments of the waste parts or x-ray examinations are not necessary. No chemicals accrue which have to be disposed of. There is also no need for any particular industrial safety measures, as would be necessary with use of an x-ray unit. An exact analysis of the chemical composition by chemical or physical methods is not necessary. Waste treatment measures, such as size reduction, shredding, purification, or removal of coatings can be spared. A completely sorted separation can be performed in a simple way with low outlay in terms of equipment and time.

The at least one geometric feature to be detected, which characterizes a specific waste part and consequently a specific material, is defined in the optical detection unit or the sorting unit. The at least one geometric feature, which can be optically detected, can be generated before and/or during the separation of the portion of the parent part to be separated.

The one or more geometric features is/are preferably selected so that it/they can be optically detected on two opposite sides of the waste part. By way of example, a continuous hole can be detected on two opposite sides at the hole opening. An indentation formed on one side can also be detected as a protrusion for example on the opposite side.

In an advantageous exemplary embodiment a marking unit can be provided and can be configured to apply an optically detectable marking to the at least one portion of the parent part to be separated, which marking constitutes at least one optically detectable geometric feature. The marking can thus characterize the material of the portion separated from the parent part and consequently the waste part. Due to the optical detection of the marking, a corresponding control signal can then be generated for the sorting unit, and unmixed sorting can be performed. The labelling can be constituted by any optically detectable characteristics on the waste part or on the portion to be separated, for example at least one geometric shape and/or at least one letter and/or at least one symbol and/or the like. Any shapes, such as a circle, polygons or the like can be produced in the portion as geometric shape. The marking is preferably three-dimensional so to speak and projects away from the bordering surface of the portion to be separated in the manner of a protrusion and/or is embodied as an indentation in relation to the bordering surface of the portion to be separated. The marking can thus be referred to as a three-dimensional marking. Such a marking can be produced by way of example by an embossing and/or drawing or another type of shaping of the portion to be separated.

In one exemplary embodiment the marking that is to be applied in a material-dependent manner is predefined to the marking unit, for example manually by an operator, depending on the material of the parent material. If, by way of example, in the case of a press line or a transfer press or also an individual press, another material is used for the fed parent parts in the event of a changeover, another material-characterising marking to be applied to the portion of the parent part to be separated can be predefined to the marking unit accordingly.

It is possible in one embodiment that the marking unit comprises at least one laser for engraving the marking into the portion of the parent part to be separated. A multiplicity of different markings for engraving can be predefined to a laser. Here, the adaptation to different parent parts consisting of different materials is possible in a very simple way.

In a preferred embodiment the device for processing the parent part comprises at least one press or at least one press station having an upper tool and a lower tool. The device can comprise a transfer press facility having different press stations or also a press line having connected individual presses.

A press or press station of the at least one press or press station can form the separation unit and for this purpose can comprise, for example, a separation tool part for separating the at least one portion to be separated. By way of example, a punching tool can be provided on the upper tool and/or lower tool. The separation unit can alternatively or additionally also comprise other separation or cutting means, for example a water jet cutting unit and/or a laser cutting unit.

Alternatively or additionally, it is also possible that a press or press station of the at least one provided press or press station comprises a shaping tool part for shaping the parent part. By way of example, the parent part can be shaped in a press or press station into a desired, for example three-dimensional form, by a drawing process. The shaping and the separation of a portion to be separated can be performed in a common press or press station or in successive presses or press stations or processing steps in the device.

When a marking unit is provided in order to introduce a marking, the marking unit can comprise at least one marking plunger. This marking plunger can be arranged on the upper tool and/or on the lower tool of a press or press station of the at least one provided press or press station. Here, the marking can be introduced into the portion of the parent part to be separated during the separation and/or shaping.

The marking unit is preferably configured to introduce the marking in such a way that it is optically detectable on two opposite sides of the portion to be separated. When introducing a marking with the aid of a marking plunger, the marking can be formed on one side by an indentation and on the other side by a corresponding protrusion or a corresponding bulge. This marking can be detected by the optical detection unit on both sides, accordingly. In particular, the cross-sectional shape of this marking formed by the indentation and by the protrusion can be identified and can be used as at least one detectable geometric feature. The marking can alternatively or additionally also comprise a complete through-passage or an engraving of the portion to be separated on both sides. Since the marking is optically detectable on both opposite sides of the portion to be separated, the position of the waste part does not play any role, or only plays a smaller role in the optical detection.

It is preferred when the optical detection unit is arranged adjacently to the sorting unit and for example before the sorting unit in the conveying direction of the conveyed waste parts. It is also advantageous when the conveying unit is assigned an individualizing unit, which is arranged before the optical detection unit in the conveying direction of the conveyed waste parts, so that the waste parts can be individually detected in succession.

The optical detection unit can comprise at least one camera for optical detection, by way of example. The at least one camera can be embodied as a monochrome camera. A monochrome camera is sufficient for the detection of at least one geometric feature of the waste part.

BRIEF DESCRIPTION OF THE DRAWINGS

Advantageous embodiments of the device and method will become clear from the claims, the description, and the drawings. Preferred exemplary embodiments of the invention will be explained in detail hereinafter on the basis of the accompanying drawings, in which:

DETAILED DESCRIPTION OF THE PARTICULAR EMBODIMENTS

Figure 1:
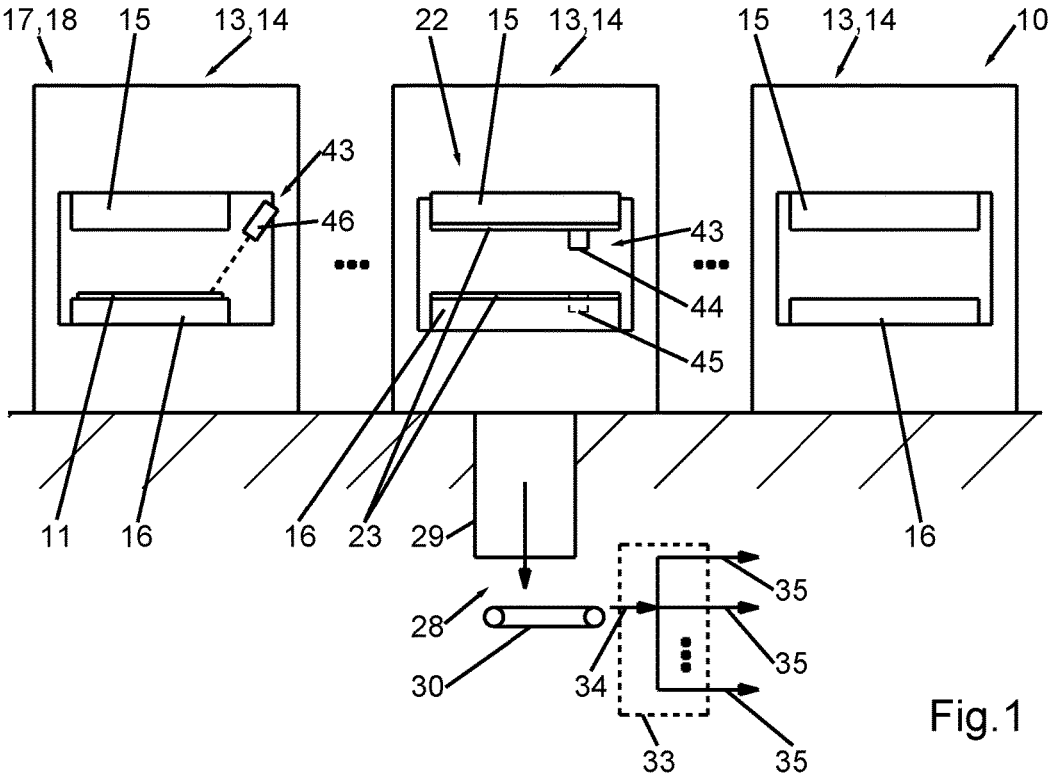
FIG. 1 shows a schematic illustration, similar to a block diagram, of an exemplary embodiment of a device 10 having a number of presses or press stations.
Figure 2:
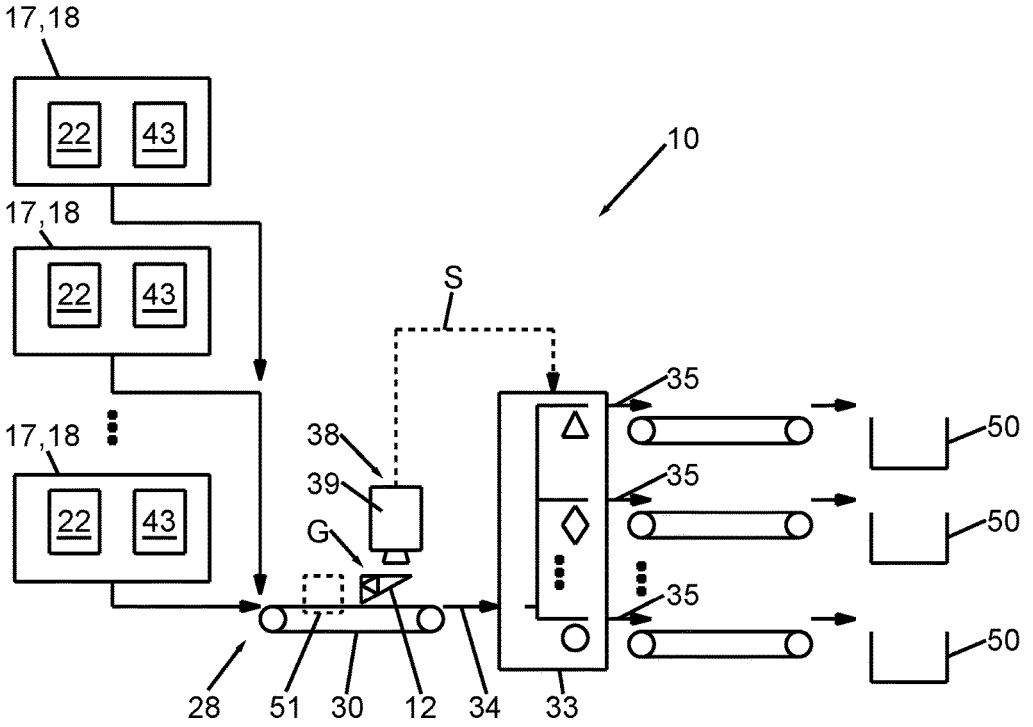
FIG. 2 shows a block diagram of an exemplary embodiment of a device, FIGS. 3 to 5 each show a schematic illustration of a parent part, portions to be separated on the parent part, and the produced part and the separated waste parts in a highly simplified schematic basic diagram.

FIGS. 1 and 2 each show an exemplary embodiment of a device 10 in a block diagram. The device 10 is configured to process metal parent parts 11 and to sort metal waste parts 12 produced during the processing. Examples of parent parts 11 and waste parts 12 are illustrated schematically in FIGS. 3 to 5. The various parent parts 11 are preferably in each case a parent part or a board. The dimensions of the parent part 11 in the two spatial directions of a plane in which the parent part 11 fundamentally extends are greater, preferably greater at least by a factor of 10, than the thickness of the parent part at right angles to this plane. The parent part 11 by way of example can be polygonal and in particular rectangular. It can also have other shapes when the parent part 11 has already been adapted in other preparative process steps to the part to be produced in the device 10.

In the preferred exemplary embodiments described here, at least one press 13 or press station 14 belongs to the device 10 and in each case has an upper tool 15 and a lower tool 16. A number of presses 13 can form a press line 17, or a number of press stations 14 can form a transfer press facility 18. One or more press lines 17 or transfer press facilities 18 can belong to the device 10. In the simplest case, the device 10 has a single press 13.

The device 10 has a separation unit 22. In the exemplary embodiment described here, the separation unit 22 can be formed on a press 13 or press station 14, for example by a punching tool part 23 attached to the upper tool 15 and/or to the lower tool 16 or formed there. The separation unit 22 can be formed consequently by a press 13 or press station 14 or can be integrated there. It is also possible to provide a separation unit 22 that is separate from a press 13 or press station 14 and that can be formed by way of example by a water jet cutting unit, a laser cutting unit, or the like. Portions 24 on the parent part 11 that are to be separated are separated with the aid of the separation unit during the processing of the parent part 11 by the device 10. Each portion 24 separated from the parent part 11 forms a waste part 12. The portions 24 on the parent part 11 that are to be separated are illustrated schematically in a dashed manner in FIGS. 3 to 5.

By way of example, the device additionally includes a conveying unit 28. The conveying unit 28 is configured to carry away the waste parts 12 from the separation unit 22, in accordance with the example a press 13 or press station 14. The conveying unit 28 can include shafts or chutes 29, conveying belts 30, conveying chains, shaking or vibrating conveying units, or any other conveying means suitable for conveying the waste parts 12 or any combination of the aforementioned units and means.

Figure 6:
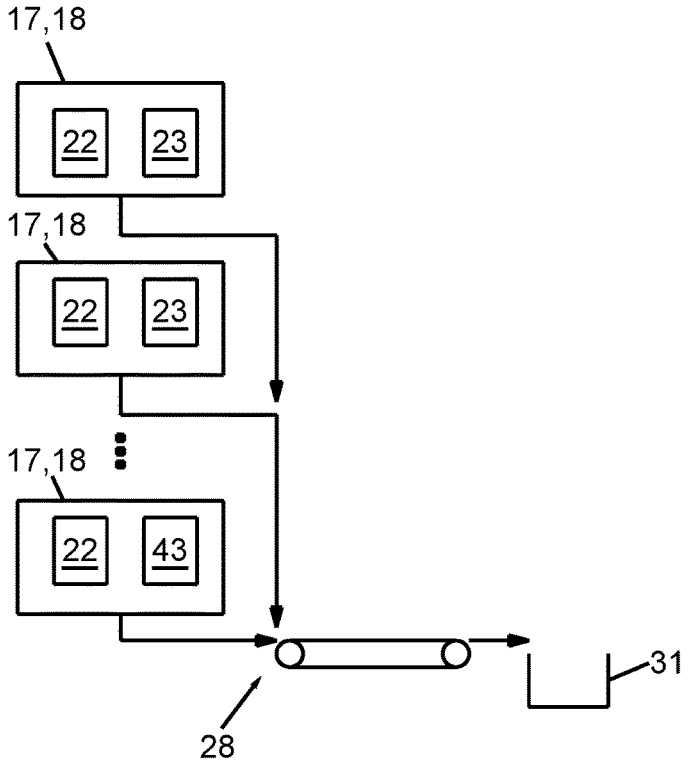
FIG. 6 shows a schematic illustration, similar to a block diagram, of an exemplary embodiment of a press arrangement comprising a plurality of presses or press stations.
Figure 7:
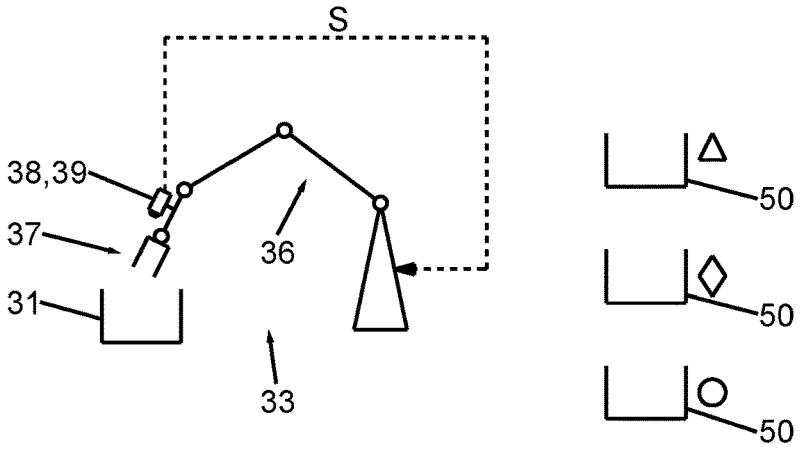
FIG. 7 shows a schematic illustration, similar to a block diagram, of an exemplary embodiment of a sorting unit for the press arrangement from FIG. 6.

By means of the conveying unit 28, the waste parts 12 in one exemplary embodiment are fed to a sorting unit 33 (FIGS. 1 and 2). It is alternatively also possible to transport away the waste parts 12 by the conveying unit 28 and to first collect these unsorted in a collection container 31 (FIG. 6). The sorting unit 33 and the separation unit 22 can be connected by means of a common conveying unit 28, as in the exemplary embodiment according to FIGS. 1 and 2, however this is not absolutely necessary. The sorting unit 33 and the separating unit 22 can also be embodied separately, without direct connection by a conveying unit (FIGS. 6 and 7).

The sorting unit 33, in accordance with the example, has at least one feed channel 34 and two or more outlet channels 35. The waste parts 12 are fed to the feed channel 34 by the conveying unit 28. For this purpose, the feed channel 34 is connected accordingly to the conveying unit 28. The sorting unit 33 can forward a waste part 12 fed at the feed channel 34 to one of the provided outlet channels 35 and can thus divide the incoming flow of waste parts 12 into outlet sub-flows, wherein the number of outlet sub-flows corresponds to the number of the outlet channels 35.

An optical detection unit 38 is assigned to the conveying unit 28 upstream of the feed channel 34 as considered in the conveying direction of the waste part 12 towards the sorting unit 33, or at the feed channel 34. The optical detection unit 38 can comprise at least one camera 39. The optical detection unit 38 additionally or alternatively can also comprise at least one scanner, for example a laser scanner. In the preferred exemplary embodiment the at least one camera 39 is embodied as a monochrome camera, for example a CMOS camera. The optical detection unit 38 detects at least one geometric feature G of each waste part 12 and generates a corresponding control signal S. The control signal S is transmitted to the sorting unit 33, wirelessly and/or in a wired manner, for example.

In the exemplary embodiment described here, the control signal S, which characterizes the at least one geometric feature, is evaluated. Depending on the at least one geometric feature, it is possible to determine the parent material part 11 from which the waste part 12 comprising the geometric feature originates. This in turn enables the assignment to the material of which the parent part 11, and consequently also the waste part 12 separated during the processing of said parent part, consists. By means of the optical detection and evaluation of the at least one geometric feature G, a division of the waste parts 12 fed to the sorting unit 33 into different material flows at the outlet channels 35 is thus possible, such that the waste parts 12 consisting of the same material are fed to each outlet channel 35. The waste parts 12 are consequently sorted or separated into specific categories.

The sorting unit 33 by way of example can also comprise at least one sorting robot 36, to which the control signal S is transmitted and which removes a waste part from the unsorted waste parts 12 and sorts this depending on the control signal S, i.e. for example deposits it in a specific container or in a specific storage unit 50 or feeds it to a specific conveying channel so as to be transported on further (FIG. 7). A waste part 12 can be grasped from the collection container 31 containing unsorted waste parts 12 or can be grasped from a conveyed flow of unsorted waste parts 12. Here, each sorting robot 36 can be assigned a separate optical detection unit 38.

The sorting robot 36 or gripper arm 37 thereof can orientate the waste part 12 in the field of view of the optical detection unit 38 such that the at least one geometric feature G can be reliably identified.

The optical detection unit 38 can also be arranged movably. The at least one waste part 12 can thus be considered from different directions. By way of example, the optical detection unit 38 can be attached to the at least one sorting robot 36, for example to the gripper arm 37 of the sorting robot. The gripper arm 37 and a grasped waste part 12 are thus always within the detection range of the optical detection unit 38. The waste part 12 can also be oriented via the gripper arm 37, for example rotated and/or tilted, in order to improve the detection of the geometric feature G.

A geometric feature G can be formed for example by the outer contour K of a waste part 12. If the waste parts 12, which consist of different materials, have outer contours K sufficiently different from one another, these can be used and evaluated as characterising feature. Additionally or alternatively to the outer contour K, one or more arbitrary other geometric features G of the waste part 12 can also be used, for example cross-sectional shapes and/or diameters of protrusions and/or indentations and/or through-passages provided there and/or the size and/or the form of an impression, etc. Any optically detectable geometric dimension and and/or shape can serve as a geometric feature G. In order to be able to distinguish the waste parts 12 from one another, a number of geometric features G of a waste part 12 can also be evaluated in combination.

In order to improve and/or enable the identification, it is also possible that the device 10 has a marking unit 43. A press line 17 or transfer press 18 can be assigned at least one marking unit 43 in each case. It is also possible to assign a separate marking unit 43 to each separation unit 22. However, it is sufficient to process each parent part 11 during processing thereof by the device 10 by means of one marking unit 43.

The marking unit 43 is configured to apply an optically detectable marking M1, M2 or M3 to one, more, or all of the portions 24 that are to be separated and are provided on the parent part 11. Such a marking M1, M2, M3 can serve as an optically detectable geometric feature. The marking M1, M2, M3 can be elevated or recessed in relation to the bordering surface of the portion 24 to be separated and consequently can form a protrusion or an indentation. A marking M1, M2, M3 of this type is preferably applied to the relevant portion 24 of the parent part 11 to be separated by means of the marking unit 43 and is optically detectable from the opposite side of the portion 24.

In one exemplary embodiment the marking unit 43 can comprise at least one marking plunger 44, which is arranged on an upper tool 15 and/or on a lower tool 16 of a press 13 or press station 14. FIG. 1, in a highly schematic manner, shows a marking plunger 44 which is arranged on the upper tool 15 on one of the presses 13 or press stations 14. A tool recess 45 complementary to the marking plunger 44 is disposed on the lower tool 16. By way of example, the cross-section of the marking plunger 44 or of the tool recess 45 and consequently the generated marking M1, M2, M3 can constitute the detectable geometric feature G.

Figure 3:
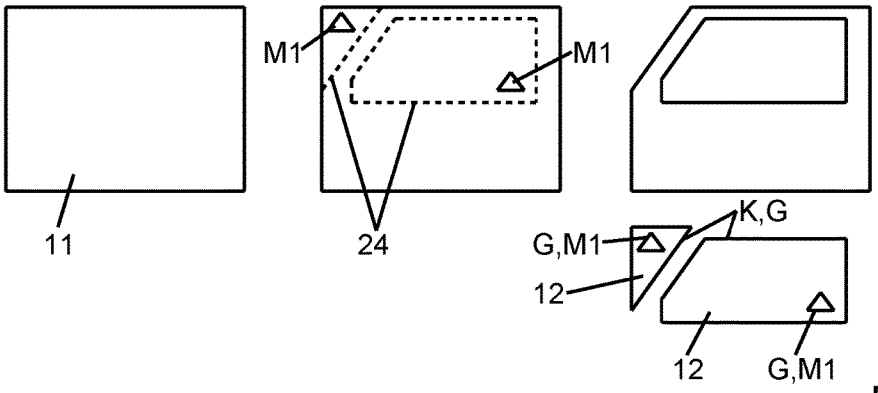
Figure 4:
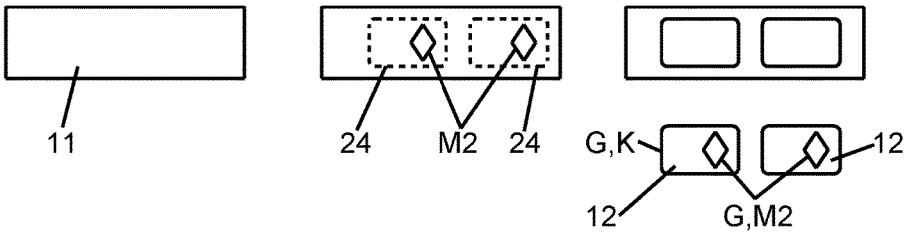
Figure 5:
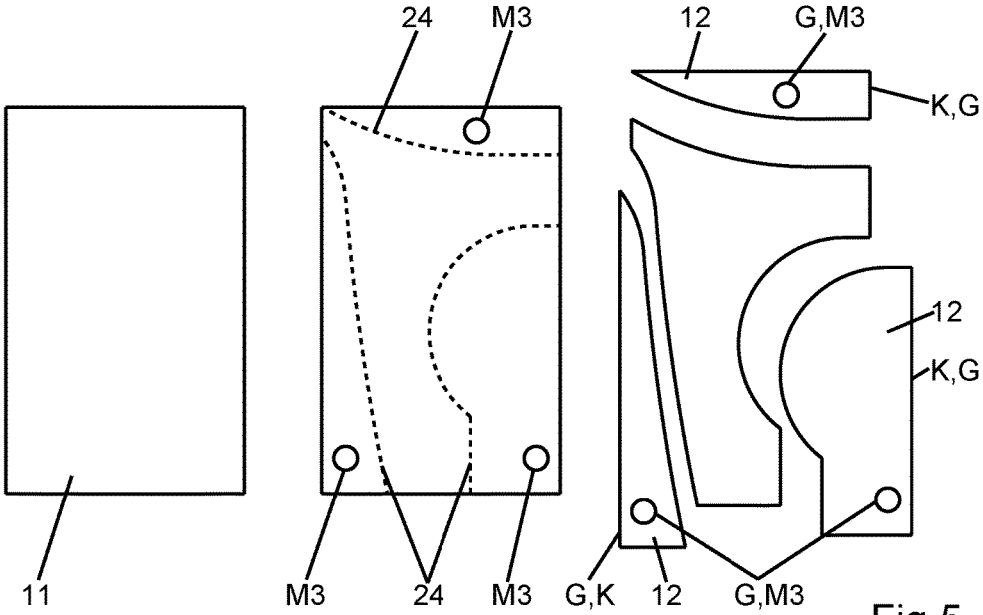

FIGS. 3 to 5 illustrate merely by way of example and schematically that, in the case of a parent part 11 an indentation and a protrusion having a triangular cross-sectional shape, in the case of a parent part 11 according to FIG. 4 an indentation and a protrusion having a diamond-shaped cross-section, and in the case of the parent part 11 according to FIG. 5 an indentation and a protrusion having a circular cross-sectional shape, can be produced by a marking plunger 44 in order to form the different features M1 or M2 or M3. The cross-sectional shape is arbitrary and principally must be detected merely by the optical detection unit 38 and preferably must be distinguishable from other cross-sectional shapes. The use of a marking plunger 44 has the advantage that an indentation is formed on one side of the portion 24 to be separated and a protrusion is formed on the other side. Here, a relevant marking M1, M2, M3, which is optically detectable from opposite sides on the waste part 12, is produced. Alternatively or additionally, it is also possible to provide the portion 24 to be separated with an impression on both sides.

With use of at least one marking plunger 43, the advantage is provided that when shaping or separating portions 24 of the parent part 11 to be separated, a relevant marking M1, M2, M3 can also be applied to the portion 24 to be separated. With a corresponding stroke of the press 13 or the press station 14, the marking M1, M2, M3 can be produced in a single operation, and the relevant portion 24 can be separated. It goes without saying that a relevant marking M1, M2, M3 can also be produced prior to the separation in a preceding operation of a preceding press 13 or press station 14.

It is additionally alternatively also possible that the marking unit 43 is introduced by a separate marking unit 43 into the at least one portion 24 to be separated. By way of example, an engraving unit can be provided for this purpose, by means of which the marking M1, M2, M3 is introduced as an engraving into the corresponding portion 24 to be separated. For engraving, the marking unit 43 can comprise a laser 46, for example (FIG. 1).

In the drawings, the exemplary embodiments of the device 10 are illustrated merely in a highly schematic manner. Depending on the number of portions 24 to be separated, an upper tool 15 and/or a lower tool 16 of a press 13 or press station 14 can also comprise a plurality of marking plungers 44. The marking plungers for different portions 24 can also be arranged on different presses 13 or press stations 14. It is merely necessary to introduce the marking M1, M2, M3 before the waste part 12 is carried away by the conveying unit 28. A separate marking unit 43 can be arranged on a press 13 or press station 14. It is also possible to provide the production of a marking M1, M2, M3 between successive presses 13 or press stations 14 as a parent part 11 is being transported on further.

The sequence of an exemplary method which can be carried out in particular with the device 10 described above will be described hereinafter.

A parent part 11 is firstly fed to the device 10 and, in accordance with the example, to a press line 17 or transfer press 18. When processing or shaping the parent part 11 into the form ultimately desired, at least one portion 24 is separated from the parent part 11 in one or more processing steps, wherein each separated portion 24 forms a waste part 12. The waste part 12 is carried away by means of the conveying unit 28 from the relevant press 13 or press stage 14, or from the press line 17 or the transfer press 18. The conveying unit 28 conveys the at least one waste part 12 to a sorting unit 33 (FIGS. 1 and 2) or into a collection container 31, which in turn can be transported to a separate sorting unit 33 (FIGS. 6 and 7). Before, or when reaching the sorting unit 33, or in the sorting unit 33, at least one geometric feature G of the waste part 12 is detected by the optical detection unit 38, and a control signal S is generated depending on the detected at least one geometric feature G and is transmitted to the sorting device 33. The waste part 12 is sorted depending on the control signal S. By way of example, the waste part 12 fed at the feed channel 34 of the sorting unit 33 can be fed to one of the provided outlet channels 35, or the sorting robot 36 deposits the waste part in a relevant storage unit 50 assigned to the control signal. In this way, waste parts 12 can be distinguished from one another and separated, depending on which parent part 12 or which material of the parent part 12 they have been separated from. A sorting of the waste parts 12 into specific categories can thus be achieved.

After the sorting into different material flows at the outlet channels 35, the waste parts can be fed via further conveying means to an assigned storage unit 50. It is also possible to press the waste parts 12 before the storage unit 50 or in the storage unit 50 in order to increase the density and reduce the storage volume.

In order to simplify the optical detection of the waste parts 12 by means of the optical detection unit 38, an individualization unit 51 can be provided as part of the conveying unit 28 before the optical detection unit 38 as considered in the conveying direction. The individualization unit 51 serves to arrange the waste parts 12 in succession in the conveying direction so that they are detected in succession by the optical detection unit 38 and are fed to the channel 34 beforehand.

The invention relates to a device 10 and a method for processing parent parts 11 and for sorting waste parts 12 thereby separated. For this purpose, an optical detection unit 38 is provided, which is configured to detect at least one geometric feature G of each waste part 12 and to generate a control signal S corresponding to the at least one detected geometric feature G. The control signal S is transmitted to a sorting unit 33. The fed waste part 12 is sorted depending on the received control signal S. It is thus possible to assign the separated waste parts 12 to a specific parent part 11. This in turn enables an assignment and determination of the material of which the waste part 12 consists, which specifically corresponds to the material of which the parent part 11 consists. By way of example, it is thus possible in the case of large press facilities to distinguish between the different waste parts 12 transported in a common material flow through a conveying unit 28, in such a way that the origin of said waste parts from a parent part 11 and consequently the material thereof can be determined. This enables the waste parts 12 to be separated into different categories.

LIST OF REFERENCE SIGNS

10 device
11 parent part
12 waste part
13 press
14 press station
15 upper tool
16 lower tool
17 press line
18 transfer press facility
22 separation unit
23 punching tool part
24 portion to be separated
28 conveying unit
29 shaft
30 conveying belt
31 collection container
33 sorting unit
34 feed channel
35 outlet channel
36 sorting robot
37 gripper arm
38 optical detection unit
39 camera
43 marking unit
44 marking plunger
45 tool recess
46 laser
50 storage unit
51 individualization unit
G geometric feature
S control signal
M1 marking
M2 marking
M3 marking

What is claimed is:

1. A device (10) for processing metal parent parts (11) and for sorting metal waste parts (12), comprising:

at least one press (13) or at least one press station (14) having an upper tool (13) and a lower tool (14) for processing the parent part (11), at least one separation unit (22), which is configured to separate at least one portion (24) of the parent part (11) to be separated, wherein each separated portion (24) forms a waste part (12), a press (13) or press station (14) of the at least one press (13) or press station (14) forms the separation unit (22) and comprises a separation tool part (23) for separating the at least one portion (24) to be separated, and/or in that a press (13) or press stage (14) of the at least one press (13) or press stage (14) comprises a shaping tool part for shaping the parent part (11), an optical detection unit (38), which is configured to detect at least one geometric feature (G) of each waste part (12), and to generate a control signal (S) corresponding to the at least one detected geometric feature (G), the at least one geometric feature (G) is the outer contour of the waste part (12) and/or the contour of a portion or region of the waste part (12), and, a sorting unit (33), which is configured to remove and to deposit and/or to convey further onwards the at least one waste part (12) fed to the sorting unit (33), depending on the control signal (S).

2. The device according to claim 1, characterized in that a marking unit (43) is provided and is configured to apply to the at least one portion (24) of the parent part (11) a marking (M1, M2, M3) which characterizes the material of the parent part (11) and which constitutes at least one optically detectable geometric feature (G).

3. The device according to claim 2, characterized in that the marking (M1, M2, M3) to be applied in a material-dependent manner is predefined to the marking unit (43) depending on the material of the parent part (11).

4. The device according to claim 2, characterized in that the marking unit (43) is configured to apply a marking (M1, M2, M3) that protrudes and/or is recessed relative to the bordering surface of the portion (24) to be separated.

5. The device according to claim 2, characterized in that the marking unit (43) comprises at least one laser (46) for engraving the marking (M1, M2, M3) into the portion (24) of the parent part (11) to be separated.

6. The device according to claim 1, characterized in that a marking unit (43) is provided and is configured to apply a marking (M1, M2, M3) characterizing the material of the parent part (11) to the at least one portion (24) of the parent part (11), and in that the marking unit (43) comprises at least one marking plunger (44), which is arranged on the upper tool (15) and/or on the lower tool (16) of a press (13) or press station (14) of the at least one press (13) or press station (14).

7. The device according to claim 2, characterized in that the marking unit (43) is configured to introduce the marking (M1, M2, M3) in such a way that it is optically detectable on two opposite sides of the waste part (12).

8. The device according to claim 1, characterized in that the sorting unit (33) comprises at least one feed channel (34) and at least two outlet channels (35), wherein the sorting unit (33) is configured to convey the at least one waste part (12) arriving at the feed channel (34) further on to one of the provided outlet channels (35) depending on the control signal (S).

9. The device according to claim 1, characterized in that a conveying unit (28) for carrying away the at least one waste part (12) is provided, and in that the optical detection unit (38) is arranged adjacently to the conveying unit (28) and is arranged before the sorting unit (33) as considered in the conveying direction of the conveyed waste parts (12), or is arranged at a feed channel (34) of the sorting unit (33).

10. The device according to claim 1, characterized in that the optical detection unit (38) comprises at least one camera (39).

11. The device according to claim 10, characterized in that the at least one camera (39) is embodied as a monochrome camera.

12. The device according to claim 1, characterized in that the sorting unit (33) comprises at least one sorting robot (36).

13. A method for processing metal parent parts (11) and for sorting metal waste parts (12) with a device (10) for processing metal parents parts (11) and for sorting metal waste parts (12), said device (10) comprising:

at least one press (13) or at least one press station (14) having an upper tool (13) and a lower tool (14) for processing the parent part (11), at least one separation unit (22), which is configured to separate at least one portion (24) of the parent part (11) to be separated, wherein each separated portion (24) forms a waste part (12), a press (13) or press station (14) of the at least one press (13) or press station (14) forms the separation unit (22) and comprises a separation tool part (23) for separating the at least one portion (24) to be separated, and/or in that a press (13) or press stage (14) of the at least one press (13) or press stage (14) comprises a shaping tool part for shaping the parent part (11), an optical detection unit (38), which is configured to detect at least one geometric feature (G) of each waste part (12), and to generate a control signal (S) corresponding to the at least one detected geometric feature (G), the at least one geometric feature (G) is the outer contour of the waste part (12) and/ or the contour of a portion or region of the waste part (12), and, a sorting unit (33), which is configured to remove and to deposit and/or to convey further onwards the at least one waste part (12) fed to the sorting unit (33), depending on the control signal (S), said method comprising the following steps:

feeding the parent part (11) to the device (10), separating the at least one portion (24) to be separated from the parent part (11) with the at least one separation unit (22), wherein each separated portion (24) forms a waste part (12), carrying away the at least one waste part (12), optically detecting with the optical detection unit (38) the at least one geometric feature (G) of each waste part (12) and generating the control signal (S) corresponding to the detected geometric feature (G), transmitting the control signal (S) to a sorting unit (33), and forwarding or removing and depositing the at least one waste part (12), with the sorting unit (33), depending on the control signal (S).

* * * * *